US008357269B2

(12) United States Patent
Smedley

(10) Patent No.: US 8,357,269 B2
(45) Date of Patent: Jan. 22, 2013

(54) INTRINSICALLY SAFE ELECTROLYSIS SYSTEM

(76) Inventor: Stuart I. Smedley, Oceanside, CA (US)

( * ) Notice: Subject to any disclaimer, the term of this patent is extended or adjusted under 35 U.S.C. 154(b) by 129 days.

(21) Appl. No.: 12/959,303

(22) Filed: Dec. 2, 2010

(65) Prior Publication Data

US 2011/0132751 A1 Jun. 9, 2011

Related U.S. Application Data

(60) Provisional application No. 61/266,258, filed on Dec. 3, 2009.

(51) Int. Cl.
*C25B 9/04* (2006.01)

(52) U.S. Cl. ..... 204/228.1; 204/242; 204/274; 205/628; 205/637

(58) Field of Classification Search ..... 204/228.1, 204/242, 274; 205/628, 637
See application file for complete search history.

(56) References Cited

U.S. PATENT DOCUMENTS

| | | | | |
|---|---|---|---|---|
| 5,382,271 | A | 1/1995 | Ng et al. | |
| 5,690,797 | A | 11/1997 | Harada et al. | |
| 6,209,493 | B1 | 4/2001 | Ross | |
| 7,850,838 | B2 * | 12/2010 | Dreier et al. | 205/637 |

OTHER PUBLICATIONS

International Search Report and Written Opinion, PCT/US2010/058993, Dec. 3, 2010.

* cited by examiner

*Primary Examiner* — Nicholas A. Smith
(74) *Attorney, Agent, or Firm* — Sean D. Burdick

(57) ABSTRACT

An intrinsically safe electrolysis system for generating hydrogen gas includes an electrolyzer containing an electrolyte and providing an outlet for generated gasses. An enclosure encloses the electrolyzer and a portion of the gas outlet. A safety interlock mounted within the enclosure and outside the electrolyzer includes a radiative element and a thermal switch, the thermal switch connected in series with a power supply for the electrolyzer and mounted in a proximity to the radiative element so that when a rated current is applied to the radiative element, the thermal switch in response to receiving heat from the radiative element changes state to provide power to the electrolyzer. The electrolyzer may generate hydrogen or oxygen gas as a fuel supplement deliverable to an internal combustion engine via the gas outlet. The electrolyzer may be mounted within a vehicle compartment that may serve as the enclosure.

20 Claims, 4 Drawing Sheets

INTRINSICALLY SAFE ELECTROLYSIS SYSTEM

This application claims priority to U.S. Provisional Application 61/266,258, which was filed on Dec. 3, 2009 and which is fully incorporated herein by reference.

BACKGROUND OF THE INVENTION

1. Field of the Invention

The present invention relates generally to electrolyzer systems, and more specifically to a water electrolyzer used as a hydrogen generator having an engineered safety feature that prevents leaked hydrogen from accumulating in dangerous amounts within a container enclosing the electrolyzer.

2. Description of Related Art

The recovery of hydrogen and oxygen gas by means of electrolysis of water has been practiced for over a century. More recently, water electrolyzers have been used for the purpose of generating and supplying a small stream of hydrogen and oxygen gas as a fuel supplement to internal combustion engines. The hydrogen/oxygen gas stream is usually only a fraction of a percent of the intake combustion air flow but evidence has been presented to show that this small stream can reduce emissions of particulates from diesel engines and in some cases also reduce emissions of NOx and provide small increases in engine fuel efficiency. Typically these water electrolyzers are powered by electrical current from the vehicle battery or alternator and are fitted to the back of the cab compartment of a truck or under the hood of a car.

To further improve the effectiveness of these devices it is necessary to minimize their volume and mass and maximize their energy efficiency for a given intended hydrogen or oxygen output. Furthermore it is important to operate an electrolyzer that can function reliably for thousands of hours in extremes of temperature, and in the presence of continuous shock and vibration and road grime and grit. Under such conditions, it is inevitable that mass production and deployment of water electrolyzers as hydrogen generators in consumer or commercial vehicles will result in some percentage of failures that involve hydrogen gas leaking from the generator to another area of the vehicle.

Principles of Electrolyzers and of Electrolysis

The science and engineering principles behind the design and operation of water electrolyzers are well known and understood. Some general principles follow.

Electrolysis of water is the decomposition of water ($H_2O$) into oxygen ($O_2$) and hydrogen gas ($H_2$) due to an electric current being passed through the water. An electrical power source is connected to two electrodes, or two plates (typically made from some inert metal such as platinum or stainless steel), which are placed in the water. Hydrogen will appear at the cathode (the negatively charged electrode, where electrons are transferred to water molecules), and oxygen will appear at the anode (the positively charged electrode where electrons are transferred from water molecules to the electrode). The generated amount of hydrogen is twice the amount of oxygen, and both are proportional to the total electrical charge transmitted through the water. Electrons carry the current in the circuit external to the electrolysis cell and in the electrodes, while charged ions carry electric current through the water or electrolyte solution.

In the water at the negatively charged cathode, a reduction reaction takes place, with electrons ($e^-$) from the cathode being given to water molecules to form hydrogen gas:

$$\text{Cathode (reduction): } 2H_2O(l)+2e^-\rightarrow H_2(g)+2OH^-(aq)$$

At the positively charged anode, an oxidation reaction occurs, where water is oxidized to generate oxygen gas and giving electrons to the anode.

$$\text{Anode (oxidation): } H_2O(l)\rightarrow \tfrac{1}{2}O_2(g)+2H^+(aq)+2e^-$$

Combining these two reactions with $$H_2O(l)\rightarrow 2H^+(aq)+2OH^-(aq)$$

yields the overall decomposition of water into oxygen and hydrogen:

$$\text{Overall Reaction: } 2H_2O(l)\rightarrow 2H_2(g)+O_2(g)$$

For every two electrons the number of hydrogen molecules produced is twice the number of oxygen molecules. Assuming equal temperature and pressure for both gases, the produced hydrogen gas has therefore twice the volume of the produced oxygen gas.

In acid solution the reactions and standard electrode potentials are $$2H^+(aq)+2e^-\rightarrow H_2(g)\ E^0=0.00V$$

$$\tfrac{1}{2}O_2(g)+2H^+(aq)+2e^-\rightarrow H_2O(l)\ E^0=1.23V$$

giving a Standard EMF of 1.23 V.

In base solution the reactions and standard electrode potentials are $$2H_2O(l)+2e^-\rightarrow H_2(g)+2OH^-(aq)\ E^0=-0.83V$$

$$\tfrac{1}{2}O_2(g)+2H_2O(l)+2e^-\rightarrow 2OH^-(aq)\ E^0=0.40V$$

giving a Standard EMF of 1.23 V.

Electric current is carried through the electrolyte solution by way of movement of ions such as $H^+$(aq) or $OH^-$(aq). However in pure water these ions are in very low concentration so an additional electrolyte must be added to allow practical values of current to flow. Typically an alkalis such as Sodium Hydroxide (NaOH) or Potassium Hydroxide (KOH) is added in quite high concentrations. A typical value for KOH would be about 30 wt %, the concentration at which the electrical conductivity reaches a maximum.

Faraday's Law provides the relationship between the current and the rate of electrolysis, where N the number of moles of gas released by a current I in time t is given by $$N=I*t/(n*F) \quad (1)$$

N is the number of electrons required to deliver one mole of gas, for hydrogen n=2 for oxygen n=4. Thus the rate of hydrogen production is given by $$\Delta I/\Delta t=I/(2*F) \quad (2)$$

The minimum voltage required to electrolyze water is 1.23 V but higher voltages must be applied in order to increase the current. Voltage drops occur at the electrodes due to overpotential and across the electrolyte gap between to two electrodes.

Overpotential ($\eta$) refers to the difference between the applied potential necessary to produce a current i and the equilibrium potential $E_0$ at zero current, $$\eta=E-E_0 \quad (3)$$

For the anode where oxygen is produced the overpotential is related to the current density by $$i=i_0\exp(-b\eta) \quad (4)$$

where $$b=\alpha nF/RT \text{ and } i=I/A \quad (5)$$

and where $i_0$ is a constant relating to the particular electrode reaction and the surface on which it occurs, e.g. platinum in KOH, $\alpha$ is a constant usually with a value of 0.5, F is the Faraday constant, R the gas constant and T temperature in K, A is the active area of the electrode and I is the actual measured current. A similar equation exists for the cathode but with different values of $i_0$ and $\alpha$. These equations can also be expressed in terms of the overvoltage as $$\eta=B\ln i_0-B\ln i=B\ln i_0/I \quad (6)$$

where B=1/b.

The gap between to two electrodes is filled with conducting electrolyte but does incur a potential drop. This potential drop is given by $$V_{electrolyte}=I*R \quad (7)$$

where I is the current and R the resistance of the electrolyte, and where $$R=A/d*\kappa \quad (8)$$

where A is the effective electrode area and d the electrode separation, $\kappa$ is the conductivity of the electrolyte which is a function of the electrolyte composition and concentration and temperature.

The Current Voltage Characteristic for a single cell is therefore given by $$V=E_0+\eta_{anode}-\eta_{cathode}+IR \quad (9)$$

$$V=E_0+B_{anode}\ln i_0/i-B_{cathode}\ln i_0/i+IR \quad (10)$$

It can be seen that for a given current the voltage can be reduced by increasing the effective surface area of the electrodes, reducing the electrode separation, increasing the concentration and temperature of the electrolyte and by catalyzing the electrodes which has the effect of increasing the value of $i_0$.

The maximum efficiency of an Electrolyzer $\epsilon$, is given by, $$\epsilon=\Delta H^0/\Delta G^0$$

where $\Delta G^0$ and $\Delta H^0$ are the standard Cibbs Energy Change and standard Enthalpy change for the electrolysis reaction. For water electrolysis the maximum efficiency is 120%. This is greater than 100% because in principle the reaction can extract heat from the surroundings. In practice, however, the efficiency is below 100% because the driving voltage is always greater than 1.23 V.

The actual efficiency is given by $$\epsilon=\Delta H^0/(nFV)$$

where V is the cell operating voltage at a given current. V is given by equation (10). At a practical current density of about 2 A $cm^{-2}$, the cell voltage is about 2 V, and this would give an efficiency of about 74%.

Electrolyzer Design

From the above descriptions and equations it can be shown that the most energy efficient electrolyzer is one that minimizes the overall cell impedance. For an electrolyzer supplied with current from a vehicle alternator operating at a constant voltage of approximately 13 V and with a current draw limited to 20 to 30 A, the impedance of the electrolyzer is minimized by reducing the electrode gap, increasing the electrolyte conductivity and increasing the number of cells in series, usually to six. Under these circumstances the electrode area is optimized to reduce cell impedance but to remain within the chosen current draw from the alternator.

If the electrolyte is potassium hydroxide the maximum conductivity occurs at about 28% by weight potassium hydroxide. An electrolyzer with 6 cells in series with stainless steel electrodes of 200 $cm^2$ and a spacing of 1 cm immersed in 28% KOH will operate at 12 V and about 30 A and produce about 1.3 L/min of hydrogen. This electrolyzer would require a minimum volume of about 1.5 L of electrolyte or about 1 L of water. This amount of water would be consumed in about 16.5 hours.

Inherent Risk

As the water is consumed, hydrogen gas is continually generated according to the Overall Reaction shown above. Given the size of the H2 molecule, leakage of the hydrogen gas from the electrolyzer system, no matter how well designed, is inevitable to some degree. If the leaked hydrogen is allowed to accumulate in an enclosed volume containing the electrolyzer, such as the trunk of a car, the volume of leaked hydrogen may reach dangerous volatile levels and pose an unacceptable risk of explosion, which could lead to passenger injury, defenestration, or worse.

The purpose of this invention is to minimize the risk by means of engineered safety features that makes the electrolyzer intrinsically safe. These features should be highly reliable, fail-safe, and should prevent hydrogen gas from accumulating in dangerous levels under the harshest expected operating conditions such as extreme temperatures, vibrations, and leakage.

SUMMARY OF THE INVENTION

The present invention discloses exemplary systems and methods for providing an intrinsically safe electrolyzer. The system includes multiple safety features designed to prevent an explosion of hydrogen gas generated by the electrolyzer. The intrinsically safe electrolyzer may be deployed, for example, in an electrolysis-based hydrogen generator used as an on-board fuel supply for an internal combustion engine.

In one embodiment, an intrinsically safe electrolysis system for generating gaseous fuel supplements for an engine includes an electrolyzer containing an electrolyte and having a gas outlet conduit that directs gas produced by the electrolyzer to an intake manifold of the engine. An enclosure is provided that encloses both the electrolyzer and the gas outlet conduit. A radiative element, such as an ohmic heating element, is mounted within the enclosure and outside the electrolyzer so that when the element is electrically energized, its radiated energy causes hydrogen gas that may have leaked from the electrolyzer into the enclosure to combine with oxygen to form water. A shroud may be provided within the enclosure to direct hydrogen toward the radiative element by convection. A safety switch, such as a bimetallic switch, is mounted adjacent to the radiative element, so that when the switch is heated by the radiative element it changes state to close an electrical circuit that provides power to the electrolyzer. The safety switch may be connected in series with a main power supply to the electrolyzer, so that the electrolyzer may not start generating hydrogen unless the radiative element is energized and therefore in a condition to convert stray hydrogen into harmless water.

In more elaborate embodiments of the invention, additional safety features may be added to the electrolysis system to further minimize the risk of explosion. In one such embodiment, a flame arrestor may be installed to fill space above the electrolyte in the path of the outlet tube to prevent gases in the electrolyzer from being ignited by heat or flame generated within a connected engine manifold. A flame arrestor may also be installed at either end of the shroud to prevent gases in the enclosure from being ignited by the radiative element.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. In the drawings, like reference numerals designate like parts throughout the different views, wherein:

DETAILED DESCRIPTION OF THE INVENTION

Figure 1:
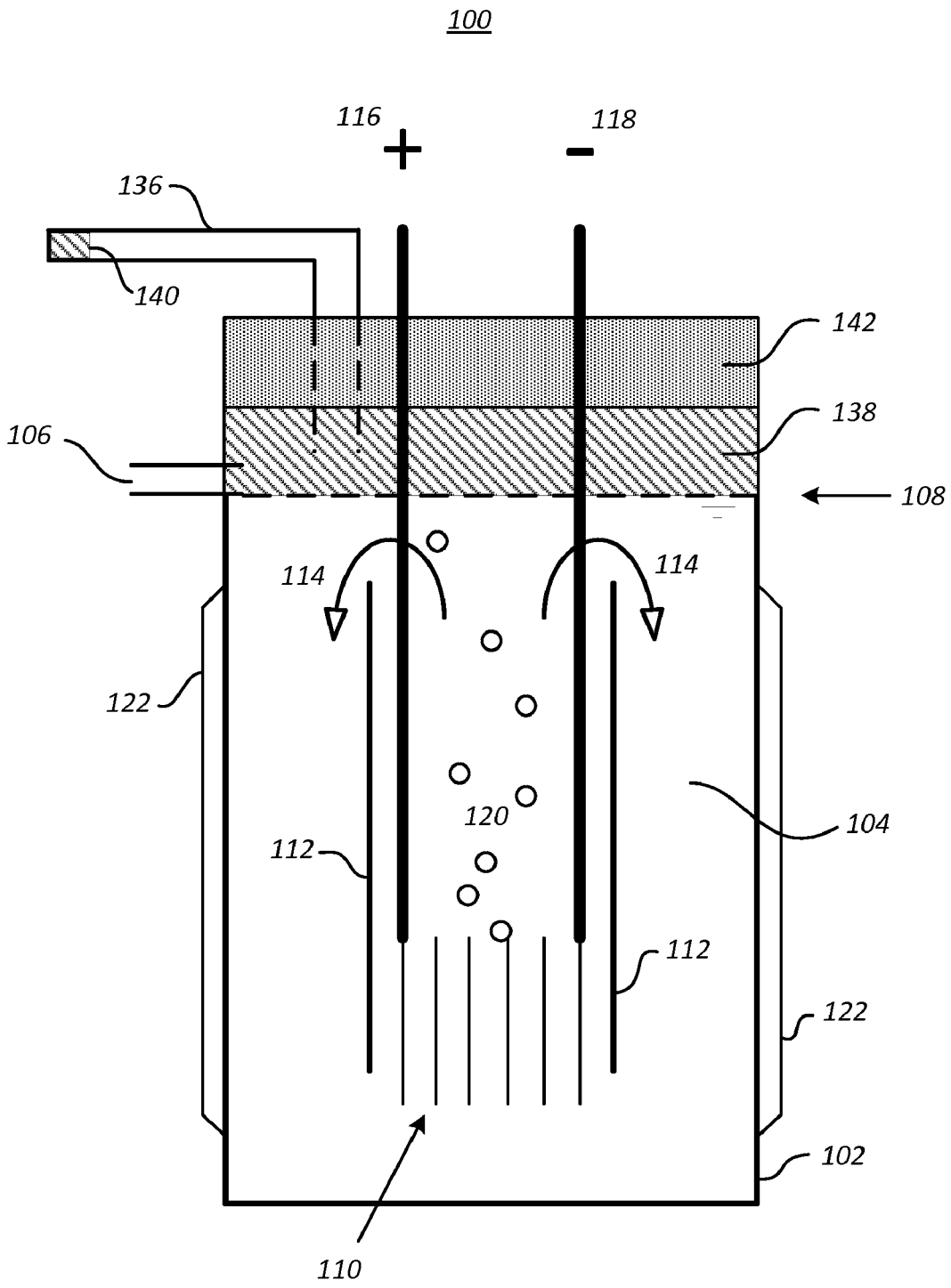
FIG. 1 is a schematic diagram of one embodiment of an electrolyzer having an intrinsic safety feature according to the invention.

The following disclosure presents an exemplary embodiment of the invention for an intrinsically safe electrolyzer. The invention provides two important safety features: (i) means to collect stray hydrogen and combine it with oxygen to form water, and (ii) a means to defeat power to the electrolyzer if the first safety feature is inoperable. The two safety features may be activated by a common component which, in an exemplary embodiment, may comprise a radiative heating element. The principles of the invention will be apparent to a skilled artisan after a complete reading of the disclosure.

Design Principles

As additional foundation for the invention, several design principles are presented herein to allow the reader to gain a more thorough understanding of the engineering basis for an intrinsically safe electrolyzer. The design principles are (i) Energy Efficiency, (ii) Volume and Mass Minimization, (iii) Robust Construction, and (iv) Safety Concerns.

1. Energy Efficiency

In an intrinsically safe electrolyzer, energy efficiency may be achieved, generally, by reducing the electrode overpotentials and the electrolyte resistance between the electrodes. Electrode overpotentials may be reduced preferably by operating at low current densities (at the expense of size and weight) but also by utilizing an electrode design that exposes a high surface area to the electrolyte. Different embodiments of the invention may achieves a relatively high surface area on an electrode by incorporating a nickel foam or sintered nickel powder, or a catalyst such as platinum or nickel, into the electrode material.

Additional energy efficiency may be achieved by reducing the resistance of the electrode gap, i.e., the spacing between cathode and anode surfaces. The resistance of the electrode gap may be reduced by making the gap very small, for example, by placing the electrode on either side of a thin (about 100 μm) porous separator. This may be achieved, in one embodiment, by constructing the separator from an inert material such as polypropylene. Another way to reduce the resistance of the electrode gap is to provide a high concentration of electrolyte in the aqueous solution to increase electrical conductivity. In one embodiment, KOH at 30 wt % may be selected for its high conductivity electrochemical stability.

Energy efficiency may also be significantly improved by avoiding the use of pumps, fans, and other auxiliary items in the overall design of the system. Thus, passive methods for circulating the electrolyte and cooling the apparatus are preferred.

2. Volume and Mass Minimization

Particularly for applications in vehicles, where space constraints and weight become limiting design factors, total volume and mass of an electrolysis-based hydrogen generator should be minimized. Volume and mass can be reduced by using intrinsically high surface area electrodes of high electrocatalytic activity, such as nickel foam or mesh coated with nickel powder and possibly catalyzed with nickel nanopowder or platinum. Also, reducing the electrode gap to a minimum reduces volume.

Volume and mass may be significantly reduced if pumps, fans, and other auxiliary items are avoided. Another advantage resulting from the minimization of volume and mass may be realized as an overall reduction in manufacturing, shipping, and handing costs.

3. Robust Construction

Electrolysis-based hydrogen generators for use in vehicles should be manufactured to standards that are consistent with achieving a rugged design that is qualified to withstand harsh operating conditions. The ratings and environmental qualifications should take into account conditions reasonably expected in marine and terrestrial applications. These include extremes in temperature (e.g., −55 C to +85 C), exposure to rain and saltwater, exposure to mechanical shock (e.g. 1 to 2 g), prolonged exposure to vibration, and operability during transients in spatial orientation (i.e. pitch, roll, yaw). In some embodiments, an alkaline electrolyzer may be selected for its intrinsic robustness. For example, an alkaline electrolyzer can remain relatively unaffected by traces of impurities in water, and will operate on unfiltered tap water for very long periods. In other embodiments, robustness in design may be achieved through the use of nickel or stainless steel in the construction of the electrodes, as these metals have an extremely long service life and will operate for tens of thousands of hours.

4. Safety Concerns

Safety is the greatest concern for any device which produces a potentially explosive mixture of gasses, such as the hydrogen and oxygen liberated by a water electrolyzer, as shown above in the Overall Reaction. The gasses output by the electrolyzer are well within the explosive composition limits, and are produced at a stoichiometry that will yield the most energy from combustion. To make the electrolyzer intrinsically safe, design bases underlying the invention are incorporated to achieve the following three levels of safety:

The first level of safety is based on developing an apparatus using excellent design principles, including specifications for high quality materials for the electrolyzer, fittings, and enclosures, and that minimizes the number of fittings, connectors, and pipes.

The second level of safety is a requirement to place the electrolyzer within an outer container or enclosure, i.e. an electrolyzer containment box, that includes an extension that covers the gas outlet pipe to a bulkhead such as the firewall under the hood of an automobile or the wall of an automobile trunk.

The third level of safety is an engineered safety feature that incorporates a device or devices that accomplishes one or more of the following: (i) scavenge any stray gas as soon as it leaks to prevent a potentially explosive accumulation; (ii) prevent operation of the electrolyzer when the means for scavenging leaked gas is not operable; (iii) detect the presence of hydrogen and prevent operation of the electrolyzer when a hydrogen leak is detected; and (iv) ventilate the space containing the electrolyzer before, during, and after electrolysis, either on a timed basis or in response to a signal received from a detector that indicates the presence of hydrogen.

Description of an Intrinsically Safe Electrolyzer

1. Overall Design

FIG. 1 shows a schematic diagram of one embodiment of an intrinsically safe electrolyzer 100 according to the invention. Electrolyzer 100 includes an outer container 102 that, during operation, is filled with an electrolyte solution 104. A filling tube or port 106 may be provided for this purpose, and may also be located at a position near the top of container 100 so that it may also served as an overflow drain. In the embodiment shown, port 106 is located to limit the electrolyte level to the elevation 108. An electrode assembly 110, which may consist of a single anode/cathode pair or multiple pairs of anodes and cathodes, are placed in the lower portion of the outer container 102 as shown. A tube 112 may surround or partially surround the electrodes 110 and extend towards the top of the container. This tube promotes convective circulation 114 within the electrolyte. It is preferred that the tube should make a tight fit with the electrode assembly to best promote convective circulation.

Convective circulation 114 is driven by the heating of the electrolyte adjacent to the electrodes as a result of the flow of electric current across potential drops at the electrodes and in the electrolyte 104. The current may be supplied to the electrode assembly by means of terminals 116 and 118 which connect to an external electrolyzer power supply. In electrolyzer 100, the terminals are shown penetrating the outer container 102 from above; however, other entry points for the terminals are possible. Convective flow of the electrolyte through the tube 112 may also occur as a result of rising bubbles of gas 120 that are generated at the electrodes 110. The convection currents thus generated carry heat away from the electrodes and transfer heat to the outer container 102, which in turn transfers heat to the surroundings. The outer container should preferably be constructed from a material having good heat transfer and corrosion resistance, such as stainless steel. Transfer of heat from the outer container to the surroundings may be improved by placing large surface area fins or heat sinks 122 on the container, or by placing the electrolyzer within a flow of air, or both. Transfer of heat by convection from the electrolysis electrodes to the surroundings avoids the need for fluid pumps or special cooling radiators or cooling fans.

2. Electrode Configurations

Figure 2:
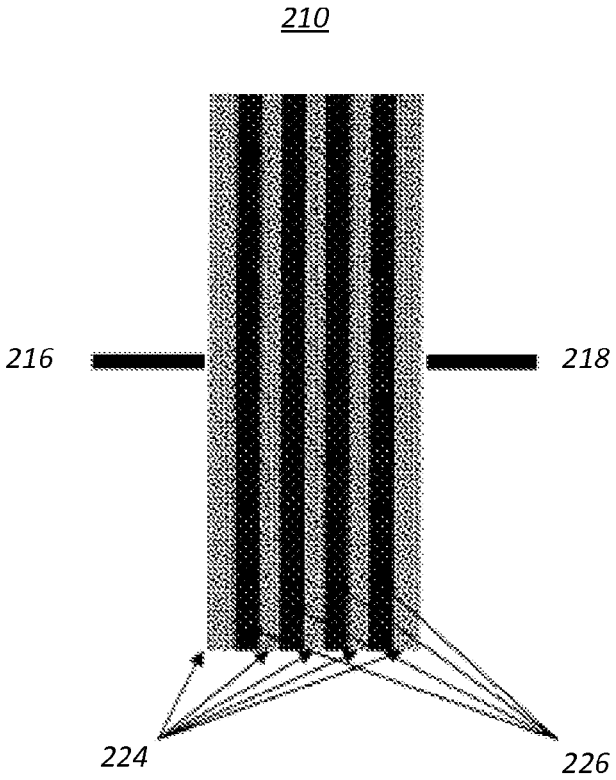
FIG. 2 is side view of a bipolar planar electrode configuration for use in an electrolyzer according to one embodiment of the invention.
Figure 3:
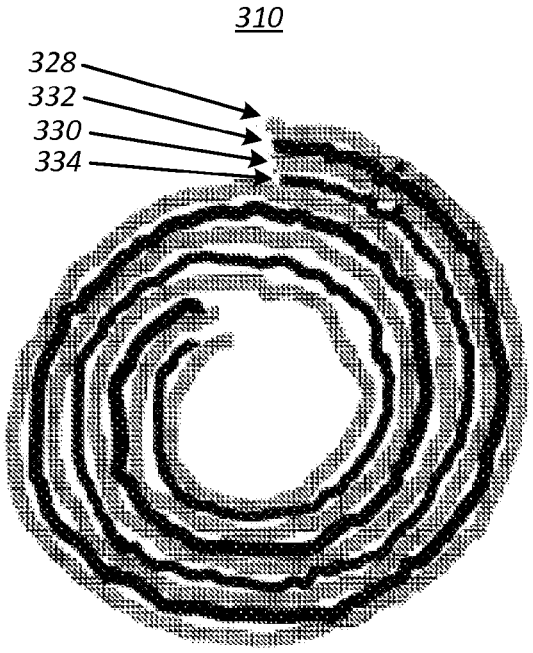
FIG. 3 is a side view of a jelly roll electrode configuration for use in an electrolyzer according to one embodiment of the invention.

FIGS. 2 and 3 show possible electrode configurations for use in the electrode assembly of electrolyzer 100. FIG. 2 shows a diagram for a bipolar electrode 210. Each cell of the bipolar electrode consists of a porous planar electrode 224. The electrodes 224 may be stacked in series, as shown, each electrode separated by a porous insulator 226. In this configuration, each electrode 224 functions as an anode on one side and as a cathode on the opposite side. The first electrode in the assembly may be connected at its anode side to an external power supply (not shown) through positive terminal 216. The last electrode in the assembly may be connected at its cathode side to the external power supply through negative terminal 218. The bipolar configuration can have up to six cells in series each operating at a maximum of 2.0 volts if the device is driven from a 12 V automotive electrical system or battery, or five cells operating at a maximum of 2.4 V, or 4 cells operating at a maximum of 3 V. This approach is very suitable for automotive applications where 12 V is readily available and precludes the need for a voltage reducing device that would be required for an electrolyzer containing, say, less than three cells in series.

In electrode stack 200, the electrodes 224 may be fabricated from a porous material through which the electrolyte 104 can readily flow and which allows an easy escape path for the bubbles of gas 120 that are generated by electrolysis. Nickel foam such as made by INCOSP is ideal for this approach—it is highly porous, about 90%, and has a high surface area to facilitate electrolysis at low overpotentials. Additionally, the surface of the foam adjacent to the separator may be coated with a catalyzing material such as Nano® Nickel as made by QSI. Coating may be satisfactorily achieved through thermal sintering or preferably by "electro-sintering" the Nano® Nickel to the nickel foam substrate. Alternatively, it may be possible to coat the nickel foam in the region adjacent to the separator with a catalyst such as platinum.

In FIG. 2, each of the electrodes 224 is shown as being in direct contact with one or two of the porous insulators 226. The porous insulator 226 may be a thin porous separator material. An example of a material suitable for this purpose is a Freudenberg Nonwoven separator material, which has a porosity of about 80%, pore size of up to 100 μm, and thickness of about 100 μm. The material should be very tough and have a very low resistance to ionic current through the electrolyte.

FIG. 3 shows a diagram for a "jelly roll" configuration for an electrode 310. This configuration is common in many batteries as a means of providing a large surface area contained within a small cylindrical volume. It is only practical to have one or at the most two separate electrodes rolled into this configuration. Electrode 310 includes a cylindrically rolled anode 328 concentrically interleaved with a cylindrically rolled cathode 330. The anode 328 and cathode 330 may be separated by two rolled, concentrically interleaved porous insulators 332 and 334, as shown. Anode 328 may be connected to the positive terminal of an external power supply, and cathode 330 may be connected to the negative terminal of the power supply. The anode, cathode, and insulators function in the same way as their counterparts in bipolar electrode 210.

The anode 328 and cathode 330 may be fabricated from a porous material through which the electrolyte can readily flow and which allows an easy escape path for the bubbles of gas 120 generated by electrolysis. Nickel foam such as made by INCOSP is ideal for this approach—it is highly porous, about 90%, but has a high surface area to facilitate electrolysis at low overpotentials. in one embodiment, the surface of the foam adjacent to the separator in electrode 310 may be coated with a catalyzing material such as Nano® Nickel as made by QSI. Coating may be achieved through thermal sintering or preferably by "electro-sintering" the Nano® Nickel to the nickel foam substrate. Alternatively it may be possible to coat the nickel foam in the region adjacent to the separator with a catalyst such as platinum. The insulators 332 and 334 may be in direct contact with the electrodes, and may be formed from a thin porous separator material, such as the Freudenberg Nonwoven separator material described above.

3. Safety Features

In operation, when the electrolyzer 100 is electrically energized and filled with electrolyte, gas bubbles formed by electrolysis reach the surface 108 of the liquid electrolyte and burst to create a fine spray of alkaline electrolyte. This spray must be condensed to liquid form and separated from the gasses to avoid passing liquid into the gas outlet 136. This may be achieved in design according to the invention by placing a mist trap or water trap 138. The mist trap 136 may be composed of a metal or plastic mesh or foam that provides relatively small pores and a relatively high surface area. The mist trap 138 should be located in the gas space above the liquid and extending slightly below the normal liquid level 108. The separation of liquid from the gas prevents caustic electrolyte from contaminating the application device into which the hydrogen and oxygen are fed, e.g., an internal combustion engine.

Preferentially, the foam or mesh used to construct the mist trap 138 would be made of metal and have very small pores. It is well known that metal mesh or foam with very small pores can prevent the progress of a flame front in combustible gasses and this material would then serve a second purpose as that of a flame arrestor. Therefore, if the gasses contained in the space above the electrolyte were ignited, the flame front would not spread through the mist trap/flame arrestor and there would be no explosion within the main body of the electrolyzer. A similar flame arrestor device 140 may be placed in the gas outlet tube adjacent to the electrolyzer and in the end of the gas transport tube 136 adjacent to the point of entry into the engine inlet manifold. The flame arrestor 140, so located, will prevent flames from an ignition source such as the engine combustion chamber traveling back down the gas tube and into the electrolyzer or vice versa.

Another safety feature provided in an electrolyzer according to the invention is one that maintains the electrolyte chamber in an essentially full state to minimize the volume of flammable gasses present in the electrolyzer. Under this condition if ignition of the gasses were to occur it would significantly minimize the energy of the explosion in addition to the flame arrestor described above. Overflow or inlet port 106, properly located, may form part of this safety feature.

In one embodiment, the electrolyzer 100 can be maintained in an essentially full condition by attaching it to a reservoir of electrolyte or water which provides more water or electrolyte to the electrolyzer as water in the electrolyzer container is electrolyzed and lost as gas through the gas outlet tube. Additions of water or electrolyte could be achieved by means of a pump activated by a level sensor in the electrolyzer body or in an attached side tube. Alternatively the water or electrolyte could be fed under gravity and flow controlled from a level sensor, or by using a "chicken feeder" device.

Alternatively the electrolyte can be continuously or intermittently circulated between an electrolyte reservoir and the electrolyzer by means of a pump. In this application the electrolyte inlet port would be below the level of the electrolyte and the overflow or outlet port 106 would determine the natural electrolyte level within the electrolyzer. The electrolyte reservoir would be provided with a filling port for additions of water or electrolyte.

The electrolyzer 100 may further be configured to include a cap or lid 142. In one embodiment, lid 142 may be fabricated from an insulating substance such as ceramic, rubber, or plastic, or from metal such as stainless steel with insulating inserts to hold the electrodes and to prevent electrical current shorts. The lid 142 may be fixed to the body of the electrolyzer by threads or by a push fit.

4. External Safety Features

The safety features described above may be incorporated into the electrolyzer design to render the device intrinsically safe. Intrinsically safe means that the risks of explosion are significantly reduced. Thus far, the safety features disclosed are primarily passive in design, meaning that no active control system is required to achieve the desired state of safety. To add another layer of safety that reduces the risk of explosion in the event of a leak of hydrogen or oxygen from the electrolyzer into spaces or volumes adjacent to the electrolyzer, the remainder of the disclosure presents an active safety feature that may work independently or in conjunction with the various features already described.

Figure 4:
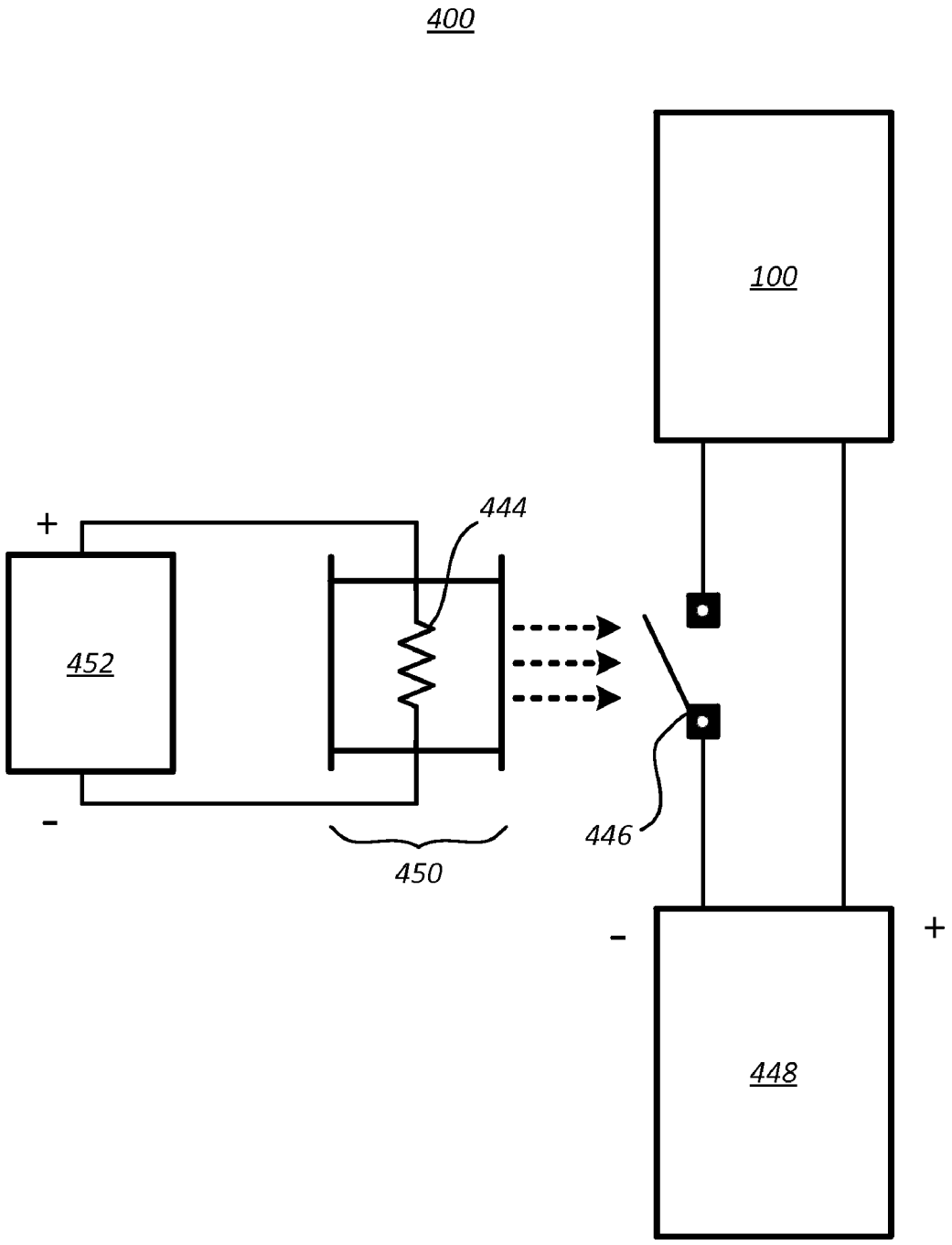
FIG. 4 is a schematic diagram of one embodiment of an engineered safety feature for use in an electrolyzer system according to the invention.

FIG. 4 shows a schematic diagram of an electric circuit 400 that may be incorporated into the design of an electrolyzer system to constantly reduce the concentration of leaking gasses to below the explosion limits. The safety feature may be described as a "hydrogen getter", which includes an electrically heated resistance element, or radiative element 444, that is heated to a radiant temperature of 500 C or higher. The element could be a platinum wire or a ceramic element. In the very close proximity of this heater, any hydrogen gas will rapidly react with available oxygen either from the electrolyzer or from the surrounding the air to form water, by reversal of the Overall Reaction. This reaction will occur at levels of hydrogen well below the lower limits of hydrogen and oxygen normally required for an explosion. As long as the radiative element 444 is operating before a leak occurs, any hydrogen that subsequently leaks will be converted to water before it can attain the lower explosion limit. In addition to the radiative element 444, the hydrogen getter may also include a shroud or shield surrounding the element that serves to channel gas to the element, and to localize the thermal radiation.

FIG. 4 shows that the electrolyzer 100 power supply circuit is in series with a thermal cut off switch 446. According to the invention, cut off switch 446 has the property that when heated, it causes a normally open contact to change state. In the power supply circuit, the change of state closes the switch, thereby turning the electrolyzer on. Other embodiments are possible in which the cut off switch is normally closed and opens in response to heat. For example, opening the switch in response to heat could deenergize a relay having normally closed contacts in series with the electrolyzer power supply. Deenergizing the relay would then close the power supply circuit.

In one embodiment, cut off switch 446 may comprise a bimetallic strip which is normally open and wired in series with power supply 448 so that in this state the electrolyzer cannot operate. Bimetallic strips are well known circuit components may be selected from among a wide range of sizes and temperature ratings. The normally open bimetallic strip is placed in a proximity to the radiative element so that when a rated current is passed through the radiative element 444, the bimetallic switch will close its contact in response to receiving heat from the radiative element. Therefore the electrolyzer can only operate when the hydrogen getter 450 is functioning. Under these circumstances even if the electrolyzer is leaking hydrogen and oxygen gasses the hydrogen getter will remove the hydrogen before it can build up to an explosive concentration. Furthermore, the feature is fail-safe because if the radiative element fails, then the bimetallic strip will cool down and open the circuit which will deenergize the electrodes and stop the electrolyzer from producing gas. For extra safety it would be possible to incorporate two or more bimetallic strips in electrical series.

For high current applications such as an electrolyzer, the bimetallic strip based switch may not be suitable. Instead it may be preferable to use the bimetallic switch to operate in a low current relay circuit. Thus, when the bimetallic switch closes the resulting current flow closes a high current relay that powers the electrolyzer. In this manner the current through the bimetallic strip can be reduced to an amp or so. Power to the radiative element 444 may be provided by a power supply 452 that is independent of the electrolyzer power supply 448, as shown. In another embodiment, both the element 444 and the electrolyzer 100 may be powered from a common source.

Figure 5:
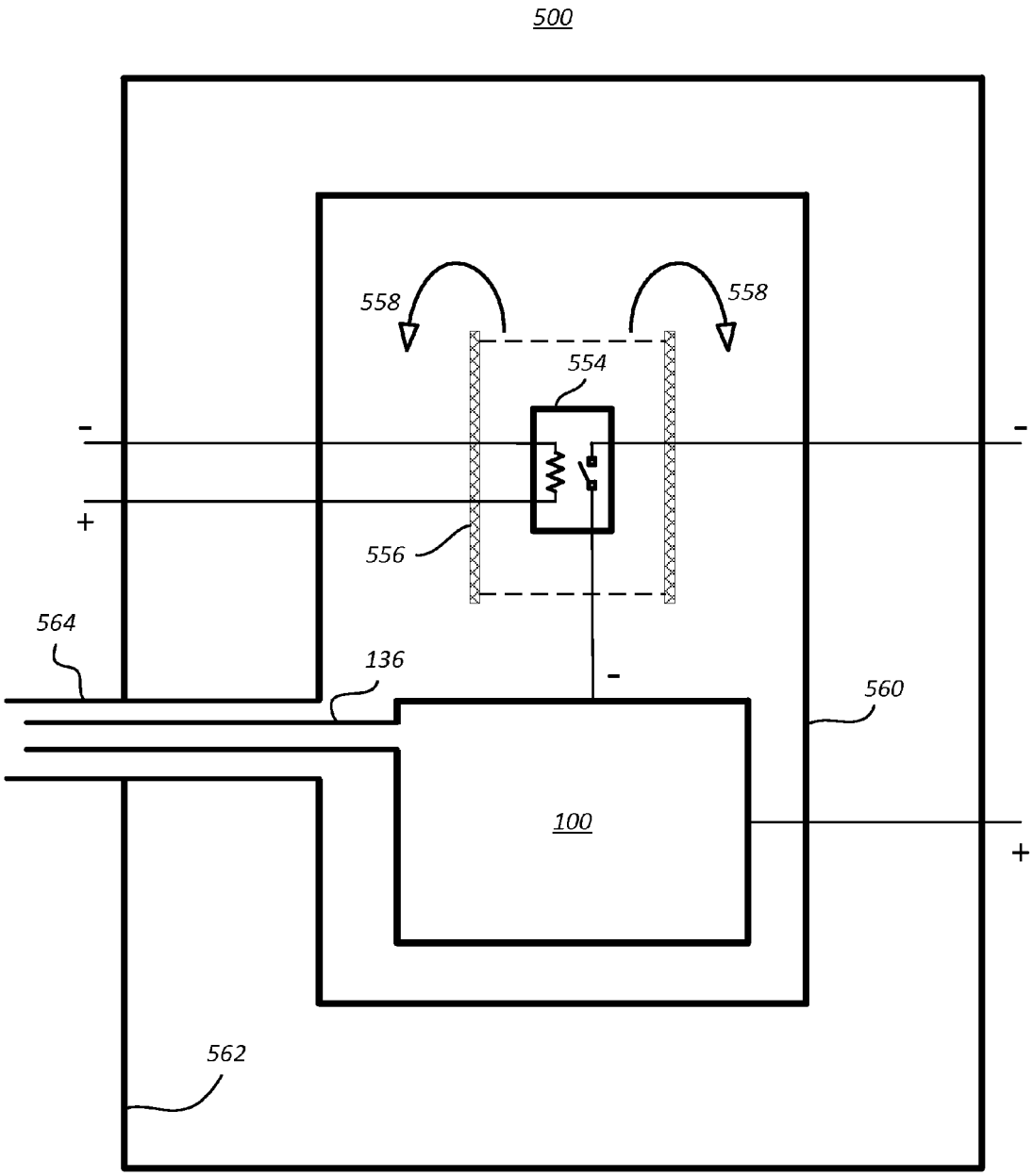
FIG. 5 is a block diagram of one embodiment of an intrinsically safe electrolysis system deployed as a hydrogen generator according to the invention.

FIG. 5 shows a block diagram of an embodiment of an intrinsically safe electrolysis system 500 deployed as a hydrogen generator according to the invention. In system 500, the radiative element and thermal switch are modeled as a single safety interlock 554. The interlock is situated within a shroud or tube 556. Collectively, the interlock 554 and shroud 556 may comprise a hydrogen getter according to the invention, and may be manufactured as a single device. Shroud 556 promotes convective circulation 558 arising from the gasses heated by the radiative element. For further safety, suitably designed flame arrestor material may be placed at either end of the shroud, thus if the radiative element were to be turned on in the presence of hydrogen and oxygen, any explosive combustion that might occur would not propagate beyond flame arrestors within the shroud. The flame arrestor material should be fabricated from metal for thermal conductivity, but should have open porosity to allow convective flow, but also have high surface area to dissipate heat from combustion and therefore annihilate flame propagation. Porous metal foam or metal "wool" are suitable materials.

In system 500, the electrolyzer 100 is placed within an outer container or electrolyzer containment box 560, and this box itself is placed within an outer container 562. The outer container 562 could be, for example, the walls of the trunk of an automobile or the firewall underneath the hood of an automobile or any other structure, moveable or stationary, that completely or partially contains the electrolyzer and electrolyzer containment box. The electrolyzer containment box 560 may completely surround the electrolyzer 100 and the electrolyzer outlet tube 136. In the embodiment shown, the electrolyzer containment box 560 also provides a vent 564 surrounding the outlet tube 136 that may vent gasses to the ambient atmosphere. This safety feature ensures that any hydrogen and oxygen gas that escapes from the electrolyzer 100 or outlet tube 136 will be prevented from access to the larger outer containment 562 and will be allowed to escape to the ambient atmosphere where it will be diluted below explosion levels. Further, the hydrogen getter within the electrolyte containment box 560 will operate to further reduce the hydrogen concentration to below explosion limits.

The invention also provides another mode of operation, wherein the electrolyzer may be operated with the hydrogen getter and shut off switch but without the enclosing electrolyzer containment box 560. This would be particularly suitable for a situation where the electrolyzer was only partially surrounded by an outer container. This situation could occur in a compartment of an automobile such as under the hood, or under a weather shroud covering a stationary internal combustion engine.

Another level of safety may be achieved by placing an electric exhaust fan or fans into the chamber containing the electrolyzer where they could be situated in a manner that exhausted gas from the electrolyzer containment box, if is one is present, and the outer containment box. This fan or fans could be timed to operate while the electrolyzer is operating and for a timed interval after operation so as to remove any hydrogen and oxygen gasses that might have accumulated. An electrical circuit could be fitted that would not allow the electrolyzer to operate in the absence of electric current to the fan or fans.

Another level of safety may be achieved by placing a hydrogen sensor or sensors into the chamber containing the electrolyzer where they could be situated in a manner to detect hydrogen in the electrolyzer containment box, if is one is present, and the outer containment box. This hydrogen detector or detectors could be timed to operate while the electrolyzer is operating. An electrical circuit could be fitted that would not allow the electrolyzer to operate in the absence of an appropriate signal from the hydrogen detector or if the detector failed.

5. Mode of Operation

An intrinsically safe electrolyzer with any combination of the foregoing safety features may be operated in the following manner. The electrolyzer gas output tube 136 is connected to an inlet conduit or manifold of internal combustion engine via a connecting tube or conduit to provide a supplementary source of fuel for the engine. During operation of the engine and the electrolyzer, a vacuum pressure in the engine manifold draws the output gasses from the electrolyzer through the gas outlet tube to supplement hydrocarbon fuel with $H_2$ and $O_2$, resulting in greater fuel efficiency and a reduction in harmful emissions. The electrolyzer and engine may also be run with the vehicle stationary to clean carbon buildup and other deposits from the engine fuel and exhaust systems.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. An intrinsically safe electrolysis system for generating gaseous fuel supplements for an engine, comprising:

an electrolyzer containing an electrolyte and having a gas outlet;

an enclosure enclosing the electrolyzer and part of the gas outlet;

a radiative element within the enclosure and outside the electrolyzer; and a safety switch that when heated by the radiative element closes an electrical circuit to provide power to the electrolyzer.

2. The system of claim 1 wherein the radiative element comprises a resistive heating element.

3. The system of claim 1 wherein the safety switch comprises a bimetallic strip.

4. The system of claim 1 wherein the gas outlet is configured to connect to an inlet manifold of an internal combustion engine.

5. The system of claim 1 further comprising within the enclosure a shroud promoting convective circulation of gases heated by the radiative element.

6. The system of claim 5 wherein the radiative element is located within the shroud.

7. The system of claim 1 mounted within an enclosed space of an automobile.

8. The system of claim 7 wherein the electrolyzer and radiative element receive power from a power supply of the automobile.

9. The system of claim 1 wherein the electrolyzer comprises one or more bipolar electrodes.

10. The system of claim 1 wherein the electrolyzer comprises one or more electrodes in a jelly roll configuration.

11. The system of claim 1 wherein the electrolyzer comprises porous electrodes separated by a porous insulator to allow passage of the electrolyte and gas.

12. The system of claim 1 wherein the electrolyzer comprises one or more electrodes and a shroud surrounding the one or more electrodes, the shroud configured to promote convective circulation of fluid within the electrolyzer.

13. The system of claim 1 wherein the electrolyzer comprises an outer container configured with a cooling fin to sink heat from the electrolyzer.

14. The system of claim 1 wherein the electrolyzer in a space above the electrolyte comprises a mist trap separating liquid from gas.

15. The system of claim 1 wherein the electrolyzer comprises a flame arrestor filling space above the electrolyte to prevent explosions.

16. The system of claim 1 further comprising a flame arrestor in the gas outlet to prevent gases in the electrolyzer from being ignited by the engine.

17. The system of claim 6 further comprising a flame arrestor at either end of the shroud to prevent gases in the enclosure from being ignited by the radiative element.

18. An intrinsically safe electrolysis system for generating hydrogen gas, comprising:

an electrolyzer containing an electrolyte and having a gas outlet;

an enclosure enclosing the electrolyzer and a portion of the gas outlet; and a safety interlock mounted within the enclosure and outside the electrolyzer, the safety interlock including a radiative element and a thermal switch, the thermal switch connected in series with a power supply for the electrolyzer and mounted in a proximity to the radiative element so that when a rated current is applied to the radiative element, the thermal switch in response to receiving heat from the radiative element changes state to provide power to the electrolyzer.

19. The system of claim 18 wherein the safety interlock further comprises a shroud configured to direct stray gas within the enclosure to the radiative element by convection.

20. The system of claim 18 wherein the radiative element and the electrolyzer are powered from a common power supply.

* * * * *